US006255030B1

(12) United States Patent
Horii et al.

(10) Patent No.: US 6,255,030 B1
(45) Date of Patent: Jul. 3, 2001

(54) PHOTOGRAPHIC PAPER

(75) Inventors: Akihiro Horii; Akihiko Konno; Masanobu Hida; Satoru Shinohara, all of Miyagi (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/446,228

(22) PCT Filed: Apr. 16, 1999

(86) PCT No.: PCT/JP99/02039

§ 371 Date: Dec. 17, 1999

§ 102(e) Date: Dec. 17, 1999

(87) PCT Pub. No.: WO99/54146

PCT Pub. Date: Oct. 28, 1999

(30) Foreign Application Priority Data

Apr. 17, 1998 (JP) ..... 10-107943

(51) Int. Cl.[7] ..... B41M 5/20; B41M 5/24; G03C 8/00

(52) U.S. Cl. ..... 430/201; 430/200; 430/213; 503/227

(58) Field of Search ..... 430/200, 201, 430/213; 503/227

(56) References Cited

U.S. PATENT DOCUMENTS 4,871,715 * 10/1989 Harrison et al. ..... 503/227
5,157,013 * 10/1992 Sakai ..... 503/227
5,457,000 * 10/1995 Defieuw et al. ..... 430/200

FOREIGN PATENT DOCUMENTS 0845367 3/1998 (EP) .
61-274990 12/1986 (JP) .
3-295685 12/1991 (JP) .
4-10984 1/1992 (JP) .
5-201161 8/1993 (JP) .
7-205556 8/1995 (JP) .

OTHER PUBLICATIONS

Supplementary European Search Report (EP 99 91 3691).
Derwent Publications Abstract for JP 05–193279 (Mar. 8, 1993).

* cited by examiner

*Primary Examiner*—Richard L. Schilling
(74) *Attorney, Agent, or Firm*—Sonnenschein, Nath & Rosenthal

(57) ABSTRACT

A developing paper having an image receiving dye layer containing a plasticizing agent on a substrate, the plasticizing agent including a solid plasticizing agent which is solid in the application temperature and a liquid plasticizing agent which is liquid in the application temperature.

Since the developing paper contains a plasticizing agent including a liquid plasticizing agent and a solid plasticizing agent, the developing paper has an excellent light resistance. Moreover, since the plasticizing agent contains a liquid plasticizing agent and a solid plasticizing agent, there is no danger of precipitation of the plasticizing agent from the surface of the developing paper. Furthermore, the developing paper containing the aforementioned plasticizing agent enables to obtain a desirable plasticizing effect.

1 Claim, 1 Drawing Sheet

PHOTOGRAPHIC PAPER

BACKGROUND OF THE INVENTION

1. Field of the Invention

The present invention relates to a developing paper for receiving dye from a thermal transfer sheet having a predetermined area heated according to an image information so as to form a dye image.

2. Description of the Prior Art

The thermal transfer recording method is widely used. That is, a predetermined area of a thermal transfer sheet is heated by a thermal head or laser according to an image information so that a dye is thermally melted or dispersed from the thermal transfer sheet onto a developing paper, so as to form an image on the developing paper. This thermal transfer sheet has an ink layer made from a predetermined concentration of dye, and the dye is transferred from this ink layer to the developing paper. Recently, a special attention is paid to a so-called sublimation type thermal transfer recording method using a thermally sublimating dye for forming a full color image of continuous gradation. For example, a thermal transfer sheet is heated in dots according to an image signal of a video image, so that an image is formed on a video developing paper.

The video developing paper includes a sheet-shaped substrate made from polypropylene on which a dye layer for receiving an image. This image receiving dye layer receives a dye portion transferred by heat from the thermal transfer sheet and holds the dye portion. The image receiving dye layer is made from a thermoplastic rest which is easily dyed such as polyester, polycarbonate, polyvinyl chloride, vinyl chloride copolymer such as vinyl chloride-vinyl acetate copolymer, polyurethane, polystyrene, AS resin, ABS resin, and the like.

The developing paper also contains a plasticizing agent added to improve the dye transfer sensitivity and light-proof characteristic.

However, in the aforementioned developing paper, the thermoplastic resin and the solid plasticizing agent used in the image receiving dye layer does not melt well into each other, and the solid plasticizing agent often precipitates on the surface of the image receiving dye layer. In such a case, precipitated portion has a high dye transfer capability, which results in an uneven concentration on the entire image. Moreover, in the aforementioned developing paper, if the image receiving dye layer contains a liquid plasticizing agent, it may ooze out due to heat or humidity.

Thus, the plasticizing improves the light-resistance of the developing paper, but causes the problems of concentration unevenness and oozing out.

SUMMARY OF THE INVENTION

It is therefore an object of the present invention to provide a developing paper having an excellent light-resistance without causing concentration unevenness and oozing out, thus enabling to obtain an excellent image.

The developing paper according to the present invention has an image receiving dye layer containing a plasticizing agent on a substrate, and the plasticizing agent includes a solid plasticizing agent which is solid in the application temperature and a liquid plasticizing agent which is liquid in the application temperature.

The developing paper according to the present invention contains the liquid plasticizing agent and solid plasticizing agent and accordingly, exhibits an excellent light resistance.

Moreover, because the plasticizing agent contains both of the liquid plasticizing agent and the solid plasticizing agent, no precipitation occurs from the surface of the developing paper. Furthermore, this developing paper containing the aforementioned plasticizing agent enables to obtain a desired plasticizing effect.

DESCRIPTION OF THE PREFERRED EMBODIMENT

Figure 1:
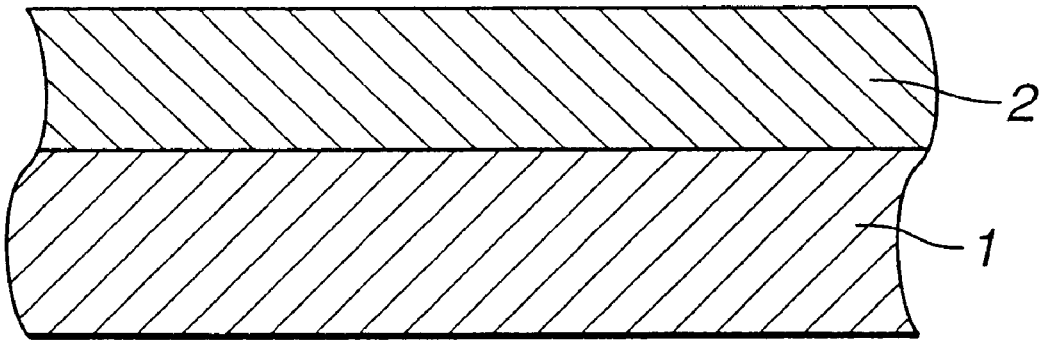
FIG. 1 is a cross sectional view of essential portion of a developing paper.

Detailed explanation will now be given on the developing paper according to the present invention.

As shown in FIG. 1, the developing paper includes a sheet-shaped substrate 1 and an image receiving dye layer 2 according to an exemplary embodiment of the present invention.

Similarly as in the conventional developing paper, the substrate 1 is made from a high quality paper, coat paper, various plastics, or layered sheet containing paper and plastics. The developing paper may have a smoothing layer or the like on the surface not having the image receiving dye layer 2.

Moreover, the image receiving dye layer 2 made from an image receiving dye layer resin solution and a plasticizing agent mixed with each other at a predetermined ratio and painted onto the aforementioned substrate 1.

The image receiving dye layer resin solution can be prepared from any of the materials conventionally used including thermoplastic resins. The thermoplastic resins may be, for example, polyester, polycarbonate, polyvinyl chloride, vinyl chloride copolymer such as vinyl chloride-vinyl acetate, polyvinyl acetoacetal, polyvinyl butiral, polyamide, vinyl acetate, polyurethane, polystyrene, AS resin, ABS resin, cellulose ester, polyvinyl alcohol and the like. Each of these materials can be used solely or in combination with others. Among the materials, especially preferable are polyester and cellulose ester from the viewpoint of improving sensitivity, image preservation, writing characteristic, and oil-resistance.

The solvent may be any of the solvents conventionally used for the aforementioned resin materials. For example, toluene, methyethylketone, and the like be used.

Moreover, the plasticizing agent contained in the image receiving dye layer 2 contains as main contents a solid plasticizing agent which is solid in the application temperature and a liquid plasticizing agent which is liquid in the application temperature. Here, the application temperature is a range from 0° C. to 45° C.

Accordingly, the solid plasticizing agent has its melting point exceeding the upper limit of the application temperature, and the liquid plasticizing agent has its melting point below the lower limit of the application temperature. That is, when the application temperature range is 0° C. to 45° C., the solid plasticizing agent has its melting point exceeding 45° C. and the liquid plasticizing agent has its melting point below 0° C.

More specifically, the solid plasticizing agent may be triphenyl phosphate (hereinafter, referred to as TPP) whose melting point is 49° C., dicyclohexyl phthalate (hereinafter, referred to as DCHP) whose melting point is 61° C., or the like. Moreover, the liquid plasticizing agent may be dimethyl phthalate (hereinafter, referred to as DMP) whose melting point is 0° C., diethyl phthalate (hereinafter referred to as DEP) whose melting point is −5° C., dioctyl phthalate (hereinafter, referred to as DOP) whose melting point is −55° C., dibutyl phthalate (hereinafter, referred to as DBP) whose melting point is −35° C., dioctyl adipate (hereinafter, referred to as DOA) whose melting point is −70° C., or the like.

Moreover, it is preferable that the content of the plasticizing agent be 5 to 30 weight parts with respect to the resin content 100 weight parts to be contained in the image receiving dye layer 2. By defining the content of the plasticizing agent in this range, it is possible to expect an excellent plasticizing effect.

If the content of the plasticizing agent is less than 5 weight parts with respect the resin content of 100 weight parts contained in the image receiving dye layer 2, the plasticizing effect may not be obtained. Moreover, if the content of the plasticizing agent exceeds 30 weight parts with respect the resin content of 100 weight parts contained in the image receiving dye layer 2, adhesive force of the surface of the developing paper becomes too large, and there arises a danger of adhesion with the thermal transfer sheet or back of another printing paper.

Moreover, the ratio of the solid plasticizing agent against the liquid plasticizing agent is preferably 1:9 to 9:1. When the ratio of the solid plasticizing agent and the liquid plasticizing agent is in this range, it is possible to prevent the dye concentration unevenness or oozing, enabling to obtain an excellent image.

If the solid plasticizing agent is contained less than 1 weight part against 10 weight parts of the plasticizing agent, the liquid plasticizing is contained relatively too much, resulting in a danger of oozing out. Moreover, if the liquid plasticizing agent is contained less than 1 weight part against 10 weight parts of the plasticizing agent, the solid plasticizing is contained relatively too much and the solid plasticizing agent may precipitate on the surface of the image receiving dye layer 2, resulting in a concentration unevenness.

It should be noted that in addition to the aforementioned plasticizing agent, it is possible to use a peeling-out agent for peeling-out characteristic. Moreover, in order to improve adhesion between the image receiving dye layer 2 and the substrate 1, it is possible to add an adhesion increasing agent such as isocyanate compound and the like.

Moreover, in this developing paper, the image receiving dye layer 2 can contain various additives. For example, the thermoplastic resin and the additive is melted in each other so as to form non-crystal state, promoting the dispersion capability of the dye (dye adhesion). Thus, the dye can be introduced into the depth of the image receiving dye layer 2, so as to improve light resistance and heat resistance. Such an additive (sensitivity increasing agent) may be various esters, ethers, and other hydrogencarbonate compounds.

Moreover, the image receiving dye layer 2 can contain a fluorescent whitening agent and a white pigment so as to increase the whiteness of the image receiving dye layer and increase clearness of the image, and make the developing paper writable characteristic as well as to prevent re-transfer of an image formed. It is possible to use the fluorescent whitening agent and the white pigment available on market. For example, as the fluorescent whitening agent, it is possible to use Uvitex OB (trade name) produced by Ciba-Geigy Co., Ltd.

Furthermore, in order to prevent generation of static electricity in the image receiving dye layer 2 during its travel in a printer, it is possible to use an antielectrostatic agent. The anti-electrostatic agent may be, for example, positive ion type surface active agent (quaternary ammonium base, polyamine derivative, and the like), negative ion surface active agent (alkylbenzensulphonate, alkylsulfuric ester sodium, and the like), ampho-ion type surface active agent, or non-ion type surface active agent. These anti-charging agent may be contained in the image receiving dye layer 2 or coated over the surface of the image receiving dye layer 2.

In addition to the aforementioned, the image receiving dye layer 2 may contain ultraviolet ray absorbing agent, anti-corrosion agent, and the like if necessary.

Moreover, the developing paper may include an intermediate layer between the substrate 1 and the image receiving dye layer 2.

The aforementioned developing paper is used together with a thermal transfer sheet in a printer apparatus and an image is transferred to the image receiving dye layer 2 according to an image information. Here, in the printer apparatus, the developing paper and the thermal transfer sheet are arranged so that the image receiving dye layer 2 faces an ink layer. According to the image information, a predetermined portion of the thermal transfer sheet is heated, and the dye in the heated area is thermally melted or dispersed, and transferred to the image receiving dye layer 2. Thus, a predetermined image is formed on the developing paper. Then, the developing paper is peeled off the thermal transfer sheet and it becomes possible to visually observe the image formed on the image receiving dye layer 2.

In this developing paper, as has been described above, the image receiving dye layer 2 contains a plasticizing agent including the liquid plasticizing agent and the solid plasticizing agent. For this, in this developing paper, the plasticizing agent will not precipitate on the surface of the image receiving dye layer 2. Moreover, it is possible to obtain a desirable adhesiveness. Accordingly, in this developing paper, there is no danger of uneven concentration or oozing out, thus enabling to obtain a preferable image.

Hereinafter, explanation will be given on Examples 1 to 16 prepared as developing paper according to the present invention and Comparative Examples 1 to 6 as well as characteristics evaluation of these.

EXAMPLE 1

In Example 1, firstly we prepared an image receiving dye layer resin having a following composition.

<Image Receiving Die Layer Resin Paint>

| | |
|---|---|
| polyester resin (trade name: Vylon 200 produced by Toyoboseki Co., Ltd.) | 100 weight parts |
| plasticizing agent (DEP:TPP = 1:9) | 30 weight parts |
| methylethyl ketone | 200 weight parts |
| toluene | 200 weight parts |

The raw materials having the aforementioned composition were mixed and agitated by a dissolver for about one hour and half before passed through a filter of 50 $\mu$m diameter to obtain an image receiving dye layer resin paint.

This image receiving dye layer resin paint was added by 5 weight parts of hardening agent (trade name N-75 produced by Nippon Polyurethane Co., Ltd.) and 5 weight parts of peel-off agent (trade name: SF8416 produced by Toray-Dow Corning Silicone Co., Ltd.). The image receiving dye layer resin paint thus prepared was applied to a synthetic paper having a thickness of 150 μm (trade name: YUPO FPG-150 produced by Oji-yuka Co., Ltd.). The image receiving dye layer resin paint was applied so as to have a thickness of 10 μm when dried. After this, the image receiving dye layer resin paint was dried at about 120° C. for 2 minutes and after this, subjected to curing at about 50° C. for 48 hours, thus obtaining a developing paper of Example 1.

Example 2

A developing paper was prepared in the same way as Example 1 except for that the plasticizing agent composition was DEP:TPP=5:5.

Example 3

A developing paper was prepared in the same way as Example 1 except for that the plasticizing agent composition was DEP:TPP=9:1.

Example 4

A developing paper was prepared in the same way as Example 1 except for that the plasticizing agent composition was DBP:TPP=5:5.

Example 5

A developing paper was prepared in the same way as Example 1 except for that the plasticizing agent composition was DBP:DCHP=5:5.

Example 6

A developing paper was prepared in the same way as Example 1 except for that the plasticizing agent composition was DOP:TPP=5:5.

Example 7

A developing paper was prepared in the same way as Example 1 except for that the plasticizing agent composition was DOP:DCHP=5:5.

Example 8

A developing paper was prepared in the same way as Example 1 except for that the plasticizing agent composition was DOA:TPP=5:5.

Example 9

A developing paper was prepared in the same way as Example 1 except for that the plasticizing agent composition was DOA:DCHP=5:5.

Example 10

A developing paper was prepared in the same way as Example 1 except for that the plasticizing agent composition was DMP:DCHP=5:5.

Example 11

A developing paper was prepared in the same way as Example 1 except for that the plasticizing agent composition was DEP:TPP=0.5:9.5.

Example 12

A developing paper was prepared in the same way as Example 1 except for that the plasticizing agent composition was DEP:TPP=9.5:0.5.

Example 13

A developing paper was prepared in the same way as Example 2 except for that the plasticizing agent added was 1 weight part.

Example 14

A developing paper was prepared in the same way as Example 2 except for that the plasticizing agent added was 5 weight parts.

Example 15

A developing paper was prepared in the same way as Example 2 except for that the plasticizing agent added was 15 weight parts.

Example 16

A developing paper was prepared in the same way as Example 2 except for that the plasticizing agent added was 40 weight parts.

Comparative Example 1

A developing paper was prepared in the same way as Example 1 except for that 30 weight parts of only DEP were added as the plasticizing agent.

Comparative Example 2

A developing paper was prepared in the same way as Example 1 except for that 30 weight parts of only TPP were added as the plasticizing agent.

Comparative Example 3

A developing paper was prepared in the same way as Example 1 except for that 30 weight parts of only DBP were added as the plasticizing agent.

Comparative Example 4

A developing paper was prepared in the same way as Example 1 except for that 30 weight parts of only DOP were added as the plasticizing agent.

Comparative Example 5

A developing paper was prepared in the same way as Example 1 except for that 30 weight parts of only DOA were added as the plasticizing agent.

Comparative Example 6

A developing paper was prepared in the same way as Example 1 except for that 30 weight parts of only DCHP were added as the plasticizing agent.

Evaluation of Characteristics

The aforementioned Examples 1 to 16 and the comparative examples 1 to 6 were checked in the following characteristics.

<Concentration Unevenness>

Firstly, using an ink ribbon (trade name: UPC-1010 produced by Sony Co., Ltd.) containing yellow (Y), magenta (M), and cyan (C) pigments on a thermal printer apparatus (trade name: UP-1200 produced by Sony Co., Ltd.), a gradation printing (developing) was performed on each of the aforementioned developing paper samples.

Images obtained were visually checked to determine that no concentration unevenness was observed (denoted by a circle ○); almost no concentration unevenness was observed (denoted by a triangle Δ); and concentration unevenness was observed (denoted by a cross ×).

<Oozing>

After performing the gradation printing (developing), the developing paper samples were maintained under the condition of a temperature 60° C. and in a humidity of 85% for 2 weeks. After this, visual observation was performed to determine 5 quality steps: 5 (no oozing, excellent) to 1 (oozing, bad).

<Maximum Concentration>

The TR-924 (trade name) produced by Macbeth Co., Ltd. was used to identify the maximum concentration (hereinafter, referred to as MAX O.D) in the images prepared for evaluation of <Concentration unevenness>. The MAX O.D was evaluated as follows.

×: MAX O.D≦1.50

○: 1.50<MAX O.D≦1.70

◎: MAX O.D>1.70

<Blocking resistance>

The blocking resistance was checked as follows. Firstly, in the process of the developing paper production, the image receiving dye layer resin paint was dried at about 120° C. for about two minutes and then cut into a size of 5 cm×5 cm. One (first) developing paper piece is placed on the dye receiving layer of another (second) developing paper piece. Then, a weight (5 kg, with a bottom 5 cm×5 cm) was placed on the first developing paper, and this state was maintained at a temperature of 50° C. for 48 hours. After this, the first developing paper piece was peeled off the second developing paper piece, and the surface condition of the dye receiving layer was checked visually to determine the evaluation as follows.

A: No change caused by the weight.

B: Partially changed.

C: Entirely changed.

The aforementioned evaluation results of the concentration unevenness and oozing are shown in Table 1 and Table 2.

TABLE 1

| | Resin Vylon 200 in weight parts | Plasticizing agent in weight parts |
|---|---|---|
| Example 1 | 100 | 30 |
| Example 2 | 100 | 30 |
| Example 3 | 100 | 30 |
| Example 4 | 100 | 30 |
| Example 5 | 100 | 30 |
| Example 6 | 100 | 30 |
| Example 7 | 100 | 30 |
| Example 8 | 100 | 30 |
| Example 9 | 100 | 30 |
| Example 10 | 100 | 30 |
| Example 11 | 100 | 30 |
| Example 12 | 100 | 30 |
| Example 13 | 100 | 1 |
| Example 14 | 100 | 5 |
| Example 15 | 100 | 15 |
| Example 16 | 100 | 40 |

| | plasticizing agent composition | | | | | | |
|---|---|---|---|---|---|---|---|
| | liquid plasticizing agent | | | | | solid plasticizing agent | |
| | DEP | DBP | DOP | DOA | DMP | TPP | DCHP |
| Example 1 | 1 | | | | | 9 | |
| Example 2 | 5 | | | | | 5 | |
| Example 3 | 9 | | | | | 1 | |
| Example 4 | | 5 | | | | 5 | |
| Example 5 | | 5 | | | | | 5 |
| Example 6 | | | 5 | | | 5 | |
| Example 7 | | | 5 | | | | 5 |
| Example 8 | | | | 5 | | 5 | |
| Example 9 | | | | 5 | | | 5 |
| Example 10 | | | | | 5 | | 5 |
| Example 11 | 0.5 | | | | | 9.5 | |
| Example 12 | 9.5 | | | | | 0.5 | |
| Example 13 | 5 | | | | | 5 | |
| Example 14 | 5 | | | | | 5 | |
| Example 15 | 5 | | | | | 5 | |
| Example 16 | 5 | | | | | 5 | |

| | concentration unevenness | oozing | MAX O.D | blocking resistance |
|---|---|---|---|---|
| Example 1 | ○ | 5 | ◎ | A |
| Example 2 | ○ | 5 | ◎ | A |
| Example 3 | ○ | 4 | ◎ | B |
| Example 4 | ○ | 5 | ◎ | A |
| Example 5 | ○ | 5 | ◎ | A |
| Example 6 | ○ | 5 | ◎ | A |
| Example 7 | ○ | 5 | ◎ | A |
| Example 8 | ○ | 5 | ◎ | A |
| Example 9 | ○ | 5 | ◎ | A |
| Example 10 | ○ | 5 | ◎ | A |
| Example 11 | Δ | 5 | ◎ | A |
| Example 12 | ○ | 3 | ◎ | B |
| Example 13 | ○ | 5 | X | A |
| Example 14 | ○ | 5 | ○ | A |
| Example 15 | ○ | 5 | ○ | A |
| Example 16 | ○ | 4 | ◎ | C |

TABLE 2

| | Resin Vylon 200 in weight parts | Plasticizing agent in weight parts |
|---|---|---|
| Comparative Example 1 | 100 | 30 |
| Comparative Example 2 | 100 | 30 |
| Comparative Example 3 | 100 | 30 |
| Comparative Example 4 | 100 | 30 |
| Comparative Example 5 | 100 | 30 |
| Comparative Example 6 | 100 | 30 |

TABLE 2-continued

| | plasticizing agent composition | | | | | | |
|---|---|---|---|---|---|---|---|
| | liquid plasticizing agent | | | | | solid plasticizing agent | |
| | DEP | DBP | DOP | DOA | DMP | TPP | DCHP |
| Comparative Example 1 | 10 | | | | | | |
| Comparative Example 2 | | | | | | 10 | |
| Comparative Example 3 | | 10 | | | | | |
| Comparative Example 4 | | | 10 | | | | |
| Comparative Example 5 | | | | 10 | | | |
| Comparative Example 6 | | | | | | | 10 |

| | concentration unevenness | oozing | MAX O.D | blocking resistance |
|---|---|---|---|---|
| Comparative Example 1 | ○ | 2 | ◎ | B |
| Comparative Example 2 | X | 5 | ◎ | A |
| Comparative Example 3 | ○ | 1 | ◎ | B |
| Comparative Example 4 | ○ | 1 | ◎ | B |
| Comparative Example 5 | ○ | 1 | ◎ | B |
| Comparative Example 6 | X | 5 | ◎ | A |

As is clear from Table 1, the developing paper samples of the Examples are capable of forming a preferable image without concentration unevenness or oozing. That is, the developing paper samples of the Examples can express a clear image.

In contrast to this, as is clear from Table 2, Comparative Examples 2 and 6 containing only a solid plasticizing agent caused precipitation of the solid plasticizing agent, resulting in concentration unevenness. Moreover, Comparative Examples 1, 3, 4, and 5 containing only a liquid plasticizing agent caused oozing, disabling to use in practice.

Moreover, comparing the Examples 1, 3, 11, and 12 to one another, it can be said that preferable results can be obtained in concentration unevenness and oozing when the ratio of the solid plasticizing agent and the liquid plasticizing agent is in a range from 1:9 to 9:1. That is, it is possible to obtain a further preferable image by forming the image receiving dye layer using a plasticizing agent containing a solid plasticizing agent and a liquid plasticizing agent is in a ratio of 1:9 to 9:1.

Furthermore, by comparing Examples 2, 13, 14, 15 and 16 to one another, all of them have preferable results in concentration unevenness and oozing. However, when the content of the plasticizing agent is less than 5 weight parts (Example 13), the MAX O.D value becomes lower, and when the content of the plasticizing agent exceeds 30 weight parts (Example 16), blocking resistance is not preferable. That is, when the content of the plasticizing agent is in a range from 5 to 30 weight parts, it is possible to obtain a developing paper preferable in the maximum concentration and blocking resistance.

Industrial Applicability

The developing paper according to the present invention includes the image receiving dye layer that contains both of a solid plasticizing agent and a liquid plasticizing agent and can form a preferable image without causing concentration unevenness or oozing. Accordingly, the developing paper according to the present invention can show a clear image.

Although modifications and changes may be suggested by those skilled in the art, it is the intention of the inventors to embody within the patent warranted hereon all changes and modifications as reasonably and properly come within the scope of their contribution to the art.

What is claimed is:

1. A developing paper having an image receiving dye layer comprising a plasticizing agent applied to a substrate at an application temperature, the plasticizing agent comprising a solid plasticizing agent selected from the group consisting essentially of triphenyl phosphate and dicyclohexyl phthalate which is solid at the application temperature and a liquid plasticizing agent selected from the group consisting essentially of dimethyl phthalate, diethyl phthalate, dioctyl phthalate, dibutyl phthalate and dioctyl adipate which is liquid at the application temperature, wherein the application temperature ranges from about 0° C. to about 45° C.

* * * * *